US005362057A

United States Patent [19]

Arima

[11] Patent Number: 5,362,057

[45] Date of Patent: Nov. 8, 1994

[54] GULF PUTTING PRACTICE GUIDE

[76] Inventor: Juichi Arima, 709 Woodmond Beach Dr. South, Kent, Wash. 98032

[21] Appl. No.: 124,672

[22] Filed: Sep. 21, 1993

[51] Int. Cl.[5] ..... A63B 69/36

[52] U.S. Cl. ..... 273/186.1; 273/192; 273/35 A

[58] Field of Search ..... 273/187.1, 192, 187.6, 273/35 A, 186.1, 183.1

[56] References Cited

U.S. PATENT DOCUMENTS

| | | | |
|---|---|---|---|
| 2,866,645 | 12/1958 | Cayot | 273/183 |
| 3,471,155 | 10/1969 | Donaldson | 273/186.1 |
| 3,934,874 | 1/1976 | Henderson | 273/35 A |
| 3,934,882 | 1/1976 | Whittaker | 273/187.1 |
| 4,004,800 | 1/1977 | Hanner | 273/187.1 |
| 4,082,287 | 4/1978 | Berkey | 273/187.6 |
| 4,230,319 | 10/1980 | Lindner | 273/192 |
| 4,334,684 | 6/1982 | Sterling | 273/192 |
| 4,413,826 | 11/1983 | Miller | 273/186 C |
| 4,423,875 | 1/1984 | Miller | 273/186 C |
| 4,826,174 | 5/1989 | Hoyt, Jr. | 273/186 R |
| 5,007,646 | 4/1991 | Baber | 273/192 |
| 5,174,566 | 12/1992 | Kelnhofer | 273/35 A |
| 5,209,484 | 5/1993 | Randall | 273/192 |

FOREIGN PATENT DOCUMENTS

| | | | |
|---|---|---|---|
| 218526 | 5/1957 | Australia | 273/192 |
| 2020983 | 11/1979 | United Kingdom | 273/192 |

*Primary Examiner*—Mark S. Graham
*Attorney, Agent, or Firm*—Seed and Berry

[57] ABSTRACT

A golf putting practice device having a bottom panel, a left side panel, a right side panel, the left and right side panels being connected to the bottom panel, and a notch that exposes a putting surface and that is adapted to receive a golf ball. The left and right side panels are perpendicularly oriented to the bottom panel and spaced apart a distance at least slightly greater than the length of the head of the golf putter. Each of the side panels has a top and a bottom edge, and a plurality of grooves in the top edge. At least one relocatable rod having a length greater than the distance between the left and right side panels is removeably positioned in corresponding grooves in the left and right side panels. The bottom panel is substantially transparent and has a reflective surface in which a golfer can see his or her reflection before, during, and after putting. Longitudinal and lateral lines on the bottom panel of the device provide the golfer with visual guides for a straight putting stroke with the head of the putter square to the straight line of the putting stroke.

34 Claims, 3 Drawing Sheets

GULF PUTTING PRACTICE GUIDE

TECHNICAL FIELD

The present invention relates to a golf practice apparatus, and more particularly, to a golf putting practice apparatus.

BACKGROUND OF THE INVENTION

To become a good golfer, a person must fully develop several different golfing skills, including putting skills. Proper putting skills are some of the most difficult to acquire, and they require continuous practice and refinement. Several different practice devices have been developed to assist golfers to improve different elements of their putting game. These elements include, for example, maintaining a proper upperbody position while putting, watching the golf ball throughout the putting stroke, swinging the putter along a straight line throughout the putting stroke, keeping the face of the putter square during the putting stroke, and striking the golf ball solidly and with proper pace. The putting practice devices, however, do not allow a golfer to simultaneously practice all of the necessary elements for a proper putting stroke. As a result, the practice devices teach the golfer a stroke that lacks one or more necessary elements. Such practice of an incomplete putting stroke often leads to bad habits and an inconsistent putting game.

One prior art device utilizes a long, rectangular frame that rests on the ground with a longitudinal cord attached to the top portion of end pieces of the frame. The cord, which is above the ground or putting surface, represents a straight line along the longitudinal axis of the frame. The cord has adjustable beads that can be positioned along its length to define limits of the backstroke and follow-through of the putting stroke. In using this practice device, the golfer attempts to swing the head of the putter under the cord along the straight line while watching the beads to determine if the backstroke and follow-through remain between the beads. However, the step of watching the beads requires that the golfer take his or her eyes off of the golf ball during the putting stroke. The cord also interferes with the golfer's concentration and line of sight during the putting stroke. Accordingly, this practice device encourages a bad habit of not watching the golf ball throughout the entire putting stroke.

A second putting practice device allows the golfer to gauge the length of the back swing without having to take his or her eyes off of the golf ball. The device has a U-shaped frame wherein vertical sidewalls are connected to a flat base such that the golfer can swing the head of the putter between the sidewalls, and a horizontal bar fits into holes in the sidewalls and extends between the side walls. The bar is intended to limit the length the back swing to a set distance. However, if the bar is hit or impacted by the putter, the entire practice device will be jolted or moved such that a golf ball, which is placed on the base portion, will be disturbed and the putting stroke disrupted. This practice device does not provide a similar rod forward of the golf ball that allows the golfer to gauge the proper length of the follow-through. Accordingly, the practice device is unforgiving for extended backstrokes, thereby teaching the golfer a shortened or hesitant backstroke to avoid disrupting the device.

Some putting practice devices have base portions that rest on the ground and the golf ball is supported by the base before being hit by the putter. After being hit, the ball rolls forward along and off the base portion onto the putting surface. The base portions do not depict a true putting surface, and the golf ball will likely change speed and direction when it rolls off of the base portion onto the putting surface. Such practice devices do not give the golfer a true reading as to the speed and direction the golf ball will travel on a true putting surface. Accordingly, these practice devices teach the golfer to strike the golf ball with different pace and direction as required for putting along the true putting surface.

SUMMARY OF THE INVENTION

The present invention provides a golf putting practice device that allows a golfer to simultaneously and correctly practice all of the necessary elements of his or her putting stroke. In a preferred embodiment, the device has a bottom panel, and left and right side panels connected to the bottom panel. The left and right side panels spaced apart at a distance at least slightly greater than the length of the head of the putter. The bottom panel has a section removed from a forward portion of the bottom panel, thereby forming a notch that exposes a putting surface between the left and right side panels. The notch is adapted to receive a golf ball, such that the golf ball will be in continuous contact with the putting surface, before, during, and after being hit by the putter.

Each of the left and right side panels has a top and a bottom edge. The top edges have a plurality of grooves therein that are spaced along the length of each side panel. At least one repositionable guide member or rod, having a length greater than the distance between the left and right side panels, is relocatably positioned in corresponding grooves in each side panel. The relocatable guide member, thus, spans between the side panels and rests in the grooves, such that it can be displaced from the grooves without causing the entire device to be moved or disrupted when the guide member is impacted by the putter.

In one embodiment of the present invention, the bottom panel is transparent and has a reflective surface whereby the golfer can see his or her reflection when looking down on the bottom panel. The bottom panel further includes visual alignment guides, such as a longitudinal centerline that represents the path of a straight putting stroke, and lateral lines transverse to the centerline that represents a correct square position of the head of the putter during the putting stroke. The side panels have substantially semicircular grooves that removeably receive rods that are perpendicular to the side panels. The grooves in the side panels are located both forward and rearward of the notch, so one rod can be placed forward of a golf ball positioned in the notch and a second rod can be placed rearward of the golf ball, thereby providing repositionable back swing and follow-through limits.

A second embodiment of the invention has grooves with sloped edges that reposition the rod back into the bottom of the groove if the rod is hit by the putter and displaced from the groove during a putting stroke. A third embodiment of the invention has grooves with a wave shape that acts to reposition the rod back into the grooves when displaced by the putter.

A fourth embodiment of the invention has collapsible side panels coupled to the bottom panel, so the practice apparatus can be, for example, easily stored or transported to a golf pulling practice area. A fifth embodiment of the invention has side panels that are removeably and adjustably connected to the bottom panel.

DETAILED DESCRIPTION OF THE INVENTION

The present invention will be more clearly understood from the following detailed description of a preferred embodiment taken in conjunction with the attached figures.

Figure 1:
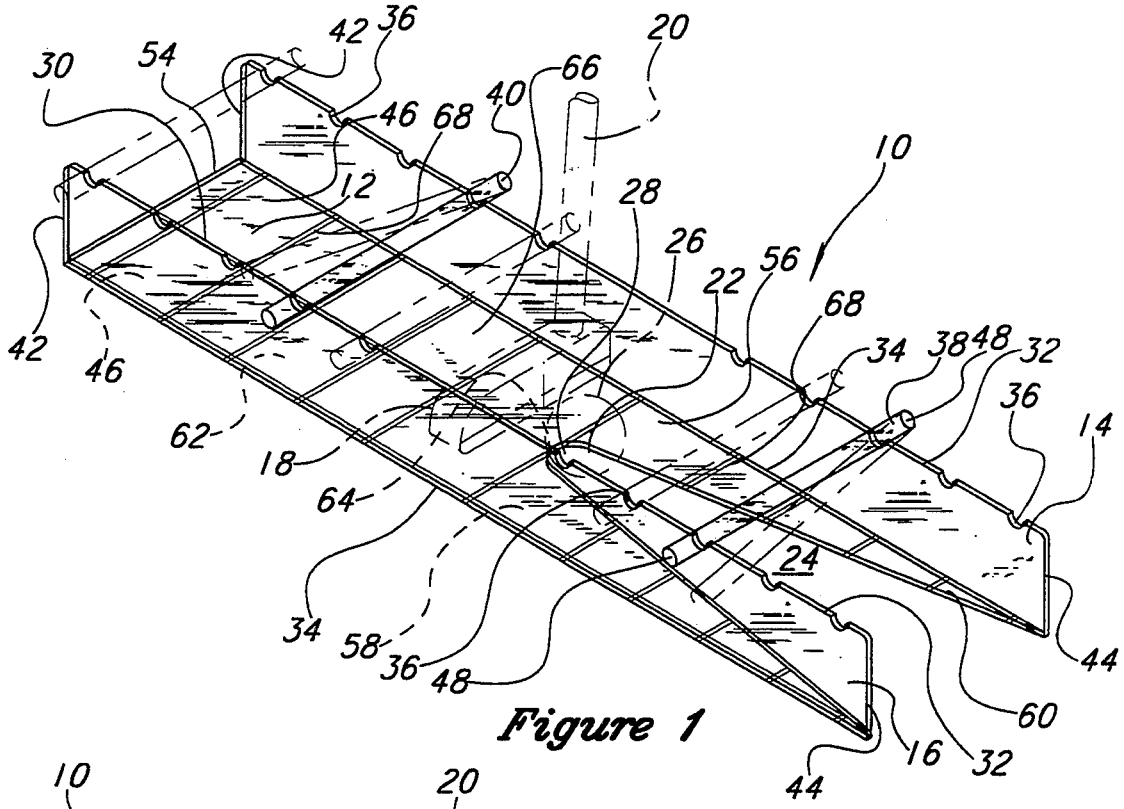
FIG. 1 is a top isometric view of a golf putting practice apparatus in accordance with the present invention with a golf putter, a golf ball, and alternate positions of guide members shown in phantom.

As seen in FIG. 1, a golf putting practice device 10 in accordance with the present invention has a bottom panel 12, a left side panel 14, and a right side panel 16. The left and right side panels 14 and 16 are attached to the bottom panel 12 and are spaced apart a distance slightly larger than the length of a head 18 of a putter golf club 20. This spacing between the side panels 14 and 16 allows a golfer to swing the putter head 18 through a putting stroke with the putter head passing above the bottom panel 12 and between the side panels.

The bottom panel 12 has a cutout area or a notch 22 therein that exposes a putting surface 24 under the bottom panel when the device is placed on the putting surface. The notch 22 is shaped and sized to receive the golf ball 26 in a starting position. In the preferred embodiment, the notch 22 has an apex 28 that is adapted to position the golf ball 26 in the same area of the notch for each practice put. The device 10 can be used by the golfer to practice his or her putting stroke with or without the golf ball 26 placed in the notch 22. The notch 22 aligns the golf ball 26 with a centerline 30 marked on the bottom panel 12, thereby locating the golf ball in a centered, starting position. Accordingly, the left and right side panels 14 and 16 assist the golfer in developing a straight putting stroke by teaching the golfer to swing the putter head 18 in a substantially straight line over the centerline 30 with the head transverse or square of the centerline.

Figure 2:
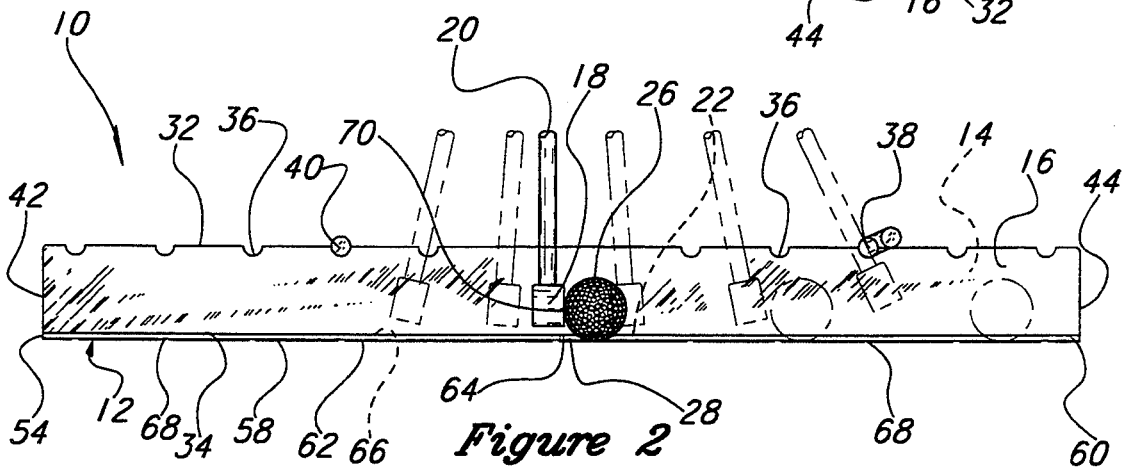
FIG. 2 is a side elevation view of the putting practice apparatus of FIG. 1 with alternate positions of the golf putter and golf ball during a putter stroke shown in phantom.
Figure 3:
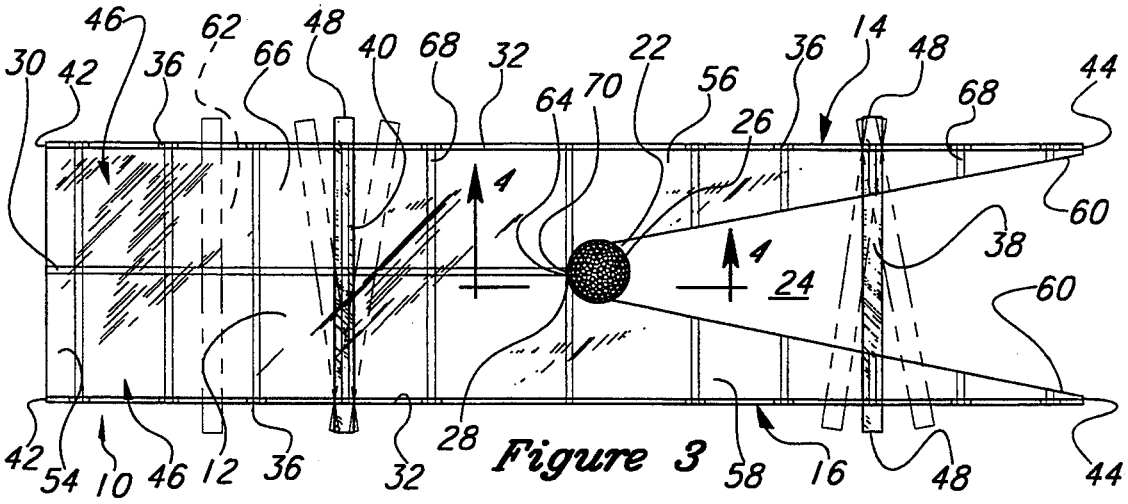
FIG. 3 is a top plan view of the golf putting practice apparatus of FIG. 1 with the golf ball shown and the golf putter removed.

As best seen in FIGS. 1, 2, and 3, each of the side panels 14 and 16 have a top edge 32 and a bottom edge 34, with a plurality of transverse grooves 36 in the top edges. The grooves 36 are positioned along the side panels 14 and 16, and shaped and sized to receive at least one rod or guide member in a position that indicates a proper length for the back swing and/or follow-through of the putting stroke. A forward rod 38, which is positioned forward of the notch 22, and a rearward rod 40, which is positioned rearward of the notch, have lengths greater than the distance between the left and right side panels 14 and 16. The rods 38 and 40 fit into corresponding grooves 36 in the top edges 32 of the left and right side panels 14 and 16, such that each rod spans between the side panels and rests in the grooves. As such, the forward rod 38 acts as a moveable limit to the follow-through of the putting stroke, and the rearward 40 rod acts as moveable limit to the back swing of the putting stroke.

Each groove 36 in the top edge 32 of the left side panel 14 is positioned directly across from a groove in the top edge of the right side panel 16. Corresponding pairs of grooves 36 on the left and right side panels 14 and 16 receive and loosely support one of the rods 38 or 40. Although the preferred embodiment uses two rods, 38 and 40, the device 10 can also be used with only one of the rods positioned across the side panels 14 and 16 when desired.

In the preferred embodiment, five substantially semicircular grooves 36 are positioned forward of the apex 28 of the notch 22, and five substantially semicircular grooves are positioned rearward of the notch. These different forward and rearward grooves 36 provide the golfer with a plurality of positions and combination of positions for the forward and rearward rods 38 and 40. A greater or few number of grooves can be used in top edges 32 of the side panels 14 and 16 and at various distances from the apex 28 of the notch 22 to achieve and teach putting strokes having different lengths of the back swing or follow-through.

As indicated above, the forward rod 38, positioned forward of the notch 22, acts as a moveable guide or limit to the length of the follow-through of the putting stroke. Similarly, the rearward rod 40, positioned rearward of notch 22, acts a moveable guide or limit to the length of the back swing of the putting stroke. If the putter 20 impacts either rod 38 or 40 during the stroke, as shown in FIG. 2 in phantom, the impacted rod will be knocked upward and, if impacted hard enough, out of the grooves 36. Such an impact on the rod 38 or 40 by the putter head 18 still allows the putting stroke to proceed, thereafter the displaced rod may be repositioned back into the desired set of grooves 36.

The rods 38 and 40, in the preferred embodiment, are cylindrical, plastic or Plexiglas rods that fit in the semicircular grooves 36, although rods or the like having other shapes can be used as guide members. The precise positioning of the rods 38 and 40 forward and rearward of the notch 22 depends upon the style of putting stroke sought to be developed and practiced. For example, in the situation where longer backstroke with a shorter follow-through is desired, the forward rod 38 is moved rearward toward the center, starting position of the golf ball 26 in the notch 22, and the rearward rod 40 is moved rearward away from the starting position. As such, the golfer can accurately view the results of the putting stroke and gauge how far and straight the golf ball 26 will roll when using the long back swing and short follow-through.

As best seen in FIGS. 1, 2, and 3, each of the side panels 14 and 16 are rectangular panels having a rear edge 42, a front edge 44, the top edge 32, and the bottom edge 34. The bottom edge 34 of each side panel 14 and 16 is attached to side portions 46 of the bottom panel 12, such that the side panels are parallel to each other and perpendicularly oriented to the bottom panel. The side panels 14 and 16 extend upward from the bottom panel 12 so as support at least the forward rod at a height above the putting surface 24 sufficiently greater than the diameter of the golf ball 26, so the golf ball can roll under the forward rod 38 without hitting it.

The side panels 14 and 16 have the same length as the bottom panel 12, whereby the device 10 has a long, channel-like shape. The side panels 14 and 16 are transparent plastic or Plexiglas panels that are adhered to the side portions 46 of the bottom panel 12 with a conventional adhesive. The side panels 14 and 16, however, could also be formed, for example, by molding the side panels from a plastic or Plexiglas sheet whereby the base panel 12 and side panels form an integral unit.

In the preferred embodiment, the rods 38 or 40 have a length such that the outer ends 48 of the rods extend beyond the side panels 14 and 16 when the rods are positioned in corresponding grooves 36 in the side panels. Accordingly, the rods 38 and 40 will be less likely to fall between the side panels 14 and 16 if the rod is hit by the putter 24 such that one or both of the outer ends 48 of the rod is pivoted to a displaced position, as shown in phantom in FIGS. 1, 2, and 3.

Figure 6:
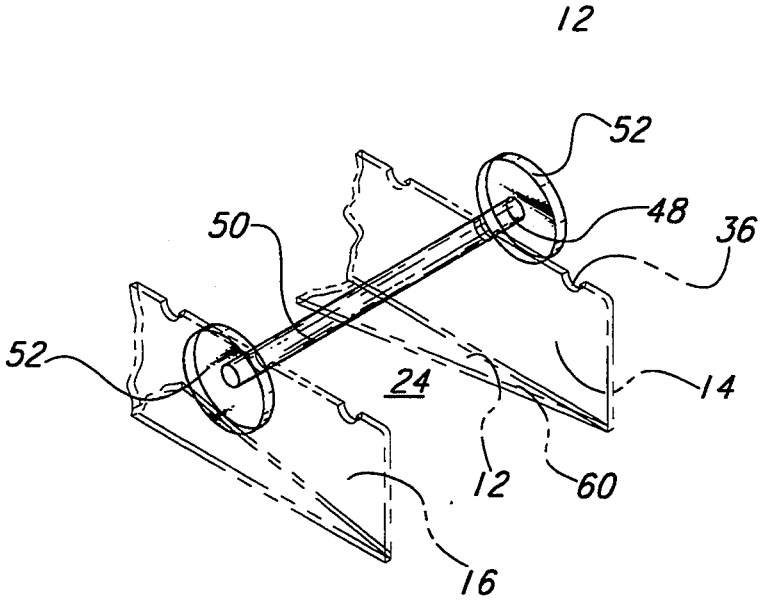
FIG. 6 is a partial front isometric view of an alternate embodiment of the putting practice apparatus with a guide member extending between side panels of the apparatus.

In an alternate embodiment of the present invention, as seen in FIG. 6, a rod 50, or other suitable guide member, has a disk 52 connected to each of the outer end portions 48 of the rod. The disks 52 overlap and are oriented parallel to the side panels 14 and 16 so the rod 50 can move longitudinally along the side walls, but the rod is prevented from pivoting and falling between the side panels. Although the preferred embodiment uses disks 52, other guide stops, such as blocks, or the like, may be used.

Referring again to FIG. 1, 2, and 3, the bottom panel 12 has a rear portion 54, a left portion 56, a right portion 58, and a front portion 60. The bottom panel 12 is oriented such that the rear portion 54 is aligned with the rear edges 42 of the left and right side panels 14 and 16. The left portion 56 is attached to the bottom edge 34 of the left side panel 14, and the right portion 58 is attached to the bottom edge 34 of the right side panel 16. The front portion 60 of the bottom panel 12 is aligned with the front edges 44 of the left and right side panels 14 and 16.

In the preferred embodiment, the bottom panel 12 is a fiat, substantially transparent panel having a bottom surface 62 that engages the putting surface 24 and a top surface 64 that faces upward away from the putting surface. The bottom panel 12 is made of plastic, Plexiglas, or the like, such that the putting surface 24 is visible through the bottom panel 12. This transparent bottom panel gives the golfer a visual image of what it is like to putt on the putting surface without using the device 10.

The bottom panel 12 also has a reflective surface, such as the top surface 64, that allows the golfer to look at his or her reflection and determine whether his or her body is in the correct position for putting. In the preferred embodiment, the plastic or Plexiglas bottom panel 12 has a sufficient reflective top surface 64 such that the golfer can see his or her reflection while also being able to see the putting surface 24 through the bottom panel.

The notch 22 in the bottom panel 12 extends rearward from the front portion 60 to the apex 28 located at a midpoint 66 of the bottom panel. In the preferred embodiment, the midpoint 66 is approximately equidistant from the front and rear portions 60 and 54 of the bottom panel 12, and is longitudinally aligned with the centerline 30. The bottom panel 12 is substantially flat and adapted to rest on the putting surface 24 over which the golf ball 26 will roll. Accordingly, the notch 22 exposes the putting surface 24 between the side panels 14 and 16 from the midpoint 66 to the front portion 60 of the bottom panel 12.

Figure 4:
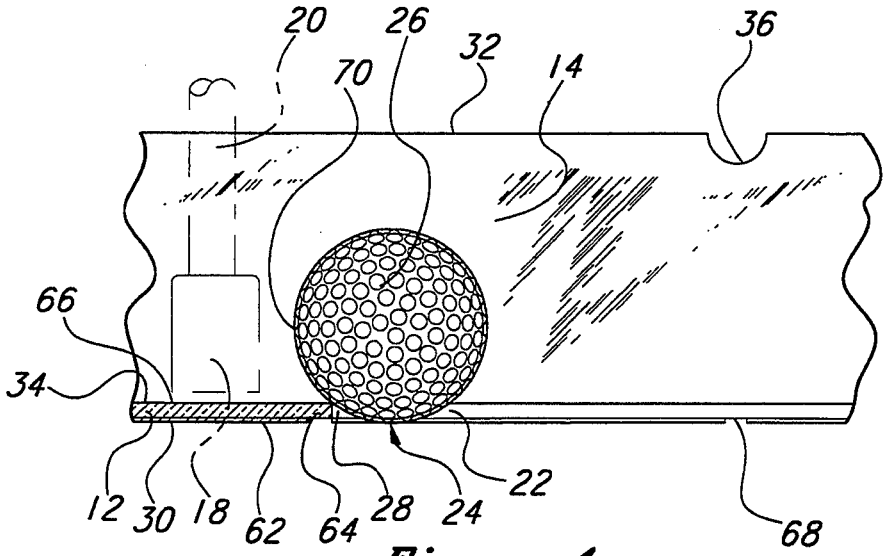
FIG. 4 is a cross-sectional view taken along lines 4—4 of FIG. 3 with the golf putter shown in phantom.

As indicated above, the apex 28 of the notch 22 is shaped and sized to receive the golf ball 26. As best seen in FIG. 4, the golf ball 26 engages the putting surface 24 and rests against the bottom panel 12 at the apex 28 of the notch 22. Thus, the golf ball 26 can be placed in the exact same position in the notch 22 for each practice putt, thereby providing a constant starting position of the golf ball for each putting stroke. When the golf ball 26 is impacted by the putter head 18, it will roll forward from the apex 28 along the exposed putting surface 24 and exit the practice device 10 through an open area in the front portion 60 of the device. As such, the golf ball 26 remains in constant contact with the putting surface 24 so the golfer can to observe the true speed and direction of the putt. This allows the golfer to accurately gauge the force required to cause the golf ball 26 to roll a proper distance in a proper direction to an intended target.

In the preferred embodiment, the notch 22 is a substantially V-shaped notch, as best seen in FIGS. 1 and 3, with the apex 28 of the "V" along the centerline 30 of the bottom panel 12 The "V" diverges from the apex 28 such that the open end of the "V" aligns with the front portion 60 of the bottom panel 12. Notches having other shapes, such as parabolic shapes, or the like, could be used in place of the V-shaped notch.

The centerline 30 on the substantially transparent bottom panel 12 is a visual alignment guide that indicates a proper path for the putter head 18 to achieve a straight putting stroke. The centerline 30 extends from the rear portion 54 of the bottom panel 12 to the apex 28 of the notch 22. The centerline 30 in the preferred embodiment is a channel formed or machined into the bottom surface 62 of the bottom panel 12, although the centerline could be drawn, taped, or otherwise put on the bottom panel.

A plurality of lateral lines 68 transverse to the centerline 30 are also provided along the length of the bottom panel 12 as visual alignment guides that allow the golfer to determine whether the putter head 18 is square to the centerline 30. In the preferred embodiment, the lateral lines 68 are channels formed or machined into the bottom surface 62 of the bottom panel 12, although these lines could also be drawn, taped, or otherwise put on the bottom panel The lateral lines 68 are aligned with the grooves 36 in the side panels 14 and 16, thereby providing an additional guide the golfer can use to gauge the proper length of the back swing and follow-through of the putting stroke. As seen in FIG. 2, a lateral line 68 is also provided across the middle area of the bottom panel 12, thereby intersecting the midpoint 66 and creating a lateral visual guide at the area where the putter head 18 contacts the golf ball 26. The plurality of lateral lines 68 can also be put along the length of the bottom panel 12 at different locations to create the desired lateral guides for the golfer.

As best seen in FIG. 4, the top surface 64 of the bottom panel 12 is a constant distance from the putting surface 24; this distance is being determined by the thickness of the bottom panel. As such, the golfer will practice the putting stroke with the putter head 18 always being at least a predetermined distance above the putting surface 24. In the preferred embodiment, the height of the bottom panel 12 is such that the putter head 18 will strike a middle portion 70 of the golf ball 26 if the putter head passes fairly close to the bottom panel. As a result, the golfer will develop a putting stroke wherein the putter head 18 will solidly strike the golf ball 26 and will not hit the putting surface 24 before or during contact with the golf ball.

Figure 5:
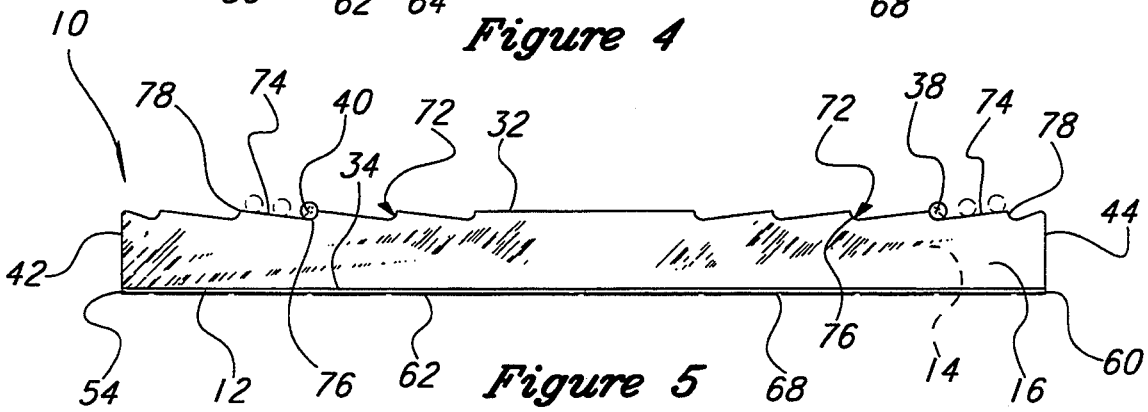
FIG. 5 is a side elevation view of an alternate embodiment of the golf putting practice apparatus with grooves in side panels having sloped edges.

In an alternate embodiment of the present invention, as best seen in FIG. 5, each side panel 14 or 16 of the device 10 has a plurality of grooves 72 in the top edge 32. Each groove 72 has at least one sloped edge 74. The sloped edge 74 slopes upward and away from the bottom 76 of the groove 72. The sloped edge 74 is shaped so as to cause the rod 38 or 40, upon being dislodged from the groove 72, to return to the bottom 76 of the groove. The sloped edges 74 extend from the bottom 76 of one grooves 72 to the top 78 of an adjacent groove. The extent of the slope of the sloped edge can be constant to form a straight-edged groove, or the slope can be varied along its length so as to form a wave-shaped groove in the side panels.

The sloped edge 74 of a groove 72 forward of the midpoint 64 is sloped rearward, such that if the forward rod 38 is knocked forward up the slope, it will tend to roll rearward back down the slope to the bottom 76 of the groove. The slope of the sloped edges 74 for the grooves 72 rearward of the midpoint 64 of the device 10 is sloped forward such that, if the rearward rod 40 is knocked rearward, it will tend to roll forward down the slope to bottom 76 of the groove. The sloped edges 74 of the grooves 72 also allow the golfer to move the rods 38 and 40 between the grooves by pushing or lifting the rod, with the end of the putter 20 to a different groove without having to bend over and pick up and move the rod by hand.

Figure 7:
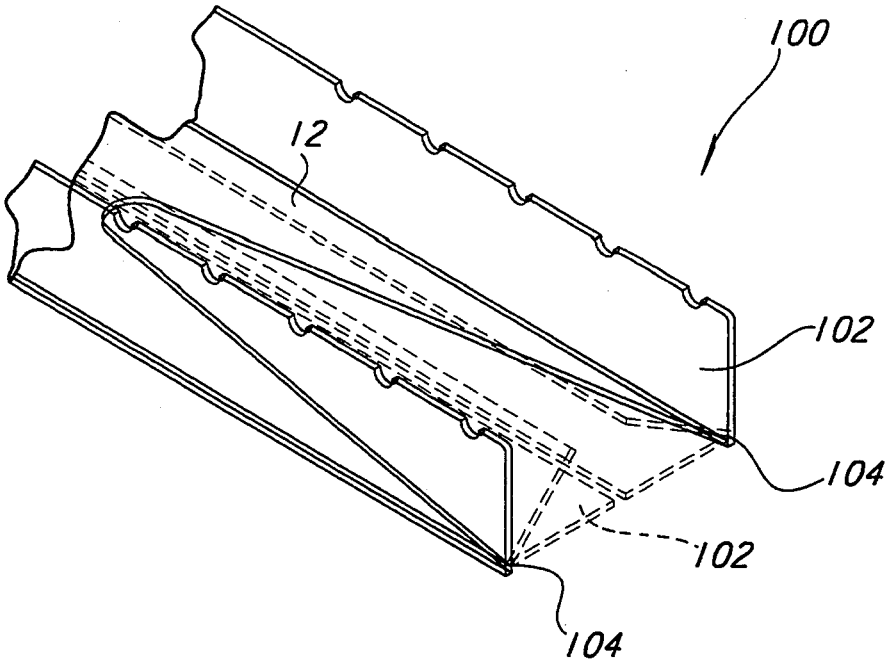
FIG. 7 is a partial front isometric view of an alternate embodiment of the putting practice guide with pivotally mounted side panels.

As best seen in FIG. 7, an alternate embodiment of the invention includes a putting practice apparatus 100 having side panels 102 pivotally attached to the bottom panel 112. For purposes of clarity, the differences between the alternate embodiment and the above embodiments will be discussed. Each of the side panels 102 is attached to a pivoting mechanism, such as a hinge 104 or the like, that allows the side panels to pivot from a vertically oriented position, to a collapsed or folded position, as seen in phantom. In this folded position, the side panels 102 lay substantially flat against the bottom panel 112 or partially over lap each other, thereby making the apparatus more compact and easier to store or transport to a putting practice area. Each side panel 102 can be pivoted independently of the other side panels as desired.

The hinge 104 is adjustable and is adhered to the side and bottom panels 102 and 112. The hinge 104 has an integral stopping mechanism that allows the side panels to be stopped or locked in the vertical position and in one or more intermediate pivoted positions, as shown in phantom in FIG. 7. Accordingly, the side panels 102 can be pivoted to an intermediate position to accommodate a putter having a smaller head or to narrow the swing path available for the putter during a putting stroke.

Figure 8:
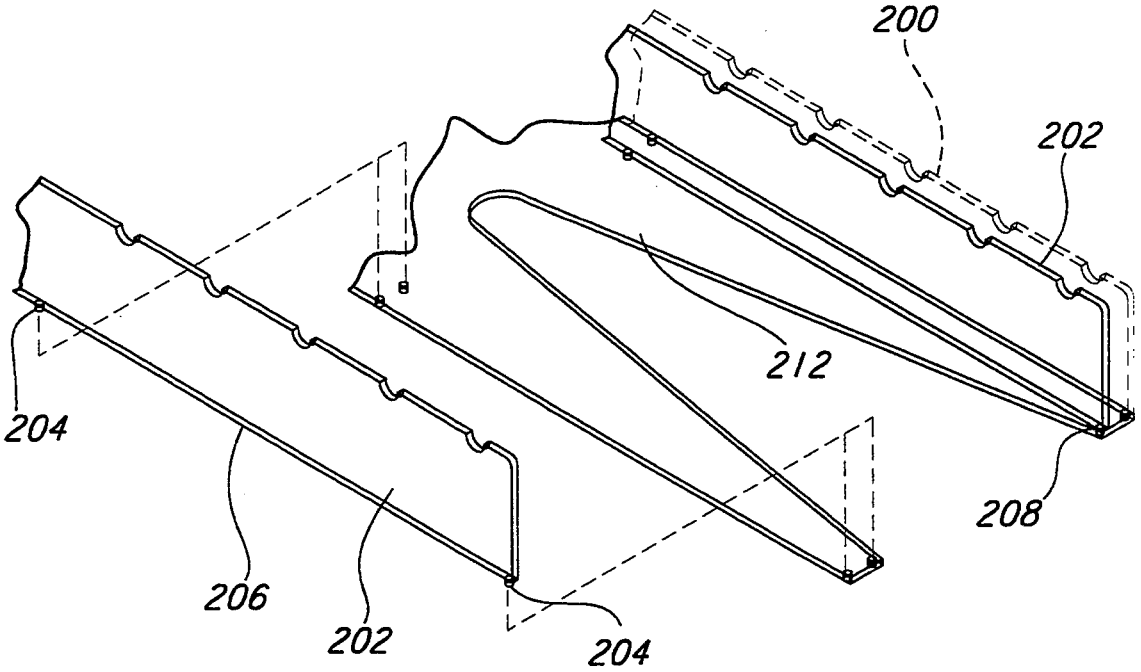
FIG. 8 is a partially exploded front isometric view of an alternate embodiment of the putting practice guide with removeable side panels.

As best seen in FIG. 8, another alternate embodiment of the invention includes a putting practice apparatus 200 having side panels 202 removeably connected to the bottom panel 212. For purposes of clarity, the differnces between the alternate embodiment and the above embodiments will be discussed. Each side panel 102 has alignment pins 204 attached to its bottom edge 206. The bottom panel 212 has a plurality of holes 208 therein that are adapted to removeably receive the alignment pins 204, such that the side panels 202 are parallel to each other, parallel to the centerline 30 on the bottom panel, and perpendicular to the bottom panel. The holes 208 are arranged in three or more sets of holes along the length of the bottom panel 212, and each set of holes have two or more holes are adjacent to each other at a set distance apart to provide alternate positions for the side panels 202. Accordingly, the side panels 202 can be adjusted between a position closer to the centerline or further away from the centerline. Such adjustment is desirable, for example, when the golf putter has a narrower or wider head, or when the golfer desires less or more room for the putter head during the putter stroke.

Numerous modifications and variations of the golf putting practice apparatus disclosed herein will occur to those skilled in the art in view of this disclosure. Therefore, it is to be understood that these modifications and variations, and equivalents thereof, may be practiced while remaining within the spirit and the scope of the invention as defined by the following claims.

I claim:

1. A golf putting practice apparatus for practicing a putting stroke with or without a golf ball, comprising:

a bottom panel having a notch therein adapted to receive the golf ball;

left and right side panels connected to said bottom side panel and spaced apart a distance at least slightly greater than the length of a head of a golf putter, said left and right side panels having top and bottom edges with a plurality of grooves in said top edges; and at least one relocatable guide member removeably coupled to said top edges of said left and right side panels and positioned in at least one of said grooves, said guide member having a length greater than said distance between said left and right side panels.

2. The golf putting practice apparatus of claim 1 wherein said left side panel has at least one of said plurality of grooves positioned across from a corresponding groove in said right side panel.

3. The golf putting practice apparatus of claim 1 wherein said guide member is a rod and said side panels have substantially semicircular grooves that are adapted to receive said rod.

4. The golf putting practice apparatus of claim 2 wherein said guide member is substantially perpendicular to said left and right side panels.

5. The golf putting practice apparatus of claim 1 wherein said left and right side panels have at least one of said plurality of grooves with a sloped edge.

6. The golf putting practice apparatus of claim 1 wherein said top edge of said left and right side panels have at least one wave-shaped groove therein.

7. The golf putting practice apparatus of claim 1 wherein said bottom panel is substantially transparent.

8. The golf putting practice apparatus of claim 1 wherein said bottom panel has a reflective surface.

9. The golf putting practice apparatus of claim 1 wherein said notch in said bottom panel exposes a putting surface between said left and right side panels, whereby the golf ball is in continuous contact with the putting surface.

10. The golf putting practice apparatus of claim 9 wherein said bottom panel has a substantially V-shaped notch adapted to receive the golf ball.

11. The golf putting practice apparatus of claim 9 wherein said left and right side panels have at least one of said plurality of grooves forward and rearward of said notch.

12. The golf putting practice apparatus of claim 1, further comprising at least one visual alignment guide coupled to said bottom panel.

13. The golf putting practice apparatus of claim 12 wherein said visual alignment guide is a longitudinal line on said bottom panel.

14. The golf putting practice apparatus of claim 12 wherein said visual alignment guide is at least one lateral line on said bottom panel.

15. The golf putting practice apparatus of claim 14 wherein said visual alignment guide further comprises a longitudinal line on said bottom panel.

16. The golf putting practice apparatus of claim 1 wherein said side panels are pivotally coupled to said bottom panel.

17. The golf putting practice apparatus of claim 16 wherein each of said side panels is coupled to said bottom panel with a hinging mechanism.

18. The golf putting practice apparatus of claim 17 wherein said hinging mechanism is adjustable to pivot said side panels to at least one partially folded position.

19. The golf putting practice apparatus of claim 1 wherein said side panels are removeably connected to said bottom panel.

20. The golf putting practice apparatus of claim 19 wherein said side panels are adjustably connected to said bottom panel such that said side panels can be adjusted between at least a first and second position on said bottom panel.

21. The golf putting practice apparatus of claim 20 wherein said side panels have alignment means connected thereto, and said bottom panel has a plurality of receiving means adapted to receive said alignment means.

22. A golf putting practice apparatus for practicing a putting stroke with or without a golf ball, comprising:

a bottom panel; and left and right side panels connected to said bottom panel and spaced apart at a distance at least slightly greater than the length of a head of a golf putter, said left and right side panels each having a top edge with a plurality of grooves therein; and at least one relocatable guide member removably coupled to said top edges of said left and right side panels and positioned in at least one of said grooves, said guide member having a length greater than said distance between said left and right side panels.

23. The golf putting practice apparatus of claim 22 wherein said bottom panel is substantially transparent.

24. The golf putting practice apparatus of claim 22 wherein said top edge has substantially semi-circular grooves.

25. The golf putting practice apparatus of claim 24 wherein said top edge of said left side panel has at least one groove therein positioned across from a corresponding groove in said top edge of said right side panel.

26. The golf putting practice apparatus of claim 22 wherein said left and right side panels have at least one of said grooves with a sloped edge.

27. The golf putting practice apparatus of 22 wherein said top edge of said left and right side panels have at least one wave-shaped groove therein.

28. The golf putting practice apparatus of claim 22 wherein said base has a notch therein that exposes a putting surface between said left and right side panels, whereby the golf ball is in continuous contact with the putting surface.

29. The golf putting practice apparatus of claim 28 wherein said bottom panel has a substantially V-shaped notch adapted to receive the golf ball.

30. The golf putting practice apparatus of claim 22, further comprising at least one visual alignment guide coupled to said bottom panel.

31. The golf putting practice apparatus of claim 30 wherein said visual alignment guide is a longitudinal line on said bottom panel.

32. The golf putting practice apparatus of claim 30 wherein said visual alignment guide is at least one lateral line on said bottom panel.

33. The golf putting practice apparatus of claim 32 wherein said visual alignment guide further comprises a longitudinal line on said bottom panel.

34. A golf putting practice apparatus, comprising a transparent frame member having a bottom panel and left and right side panels connected to said bottom panel, said bottom panel having a V-shaped notch therein that is adapted to receive a golf ball such that the golf ball contacts said bottom panel and remains in contact with a putting surface, and each of said side panels having a top edge, said top edges having a plurality of grooves therein with a guide member coupled to said top edges and positioned in at least one of said grooves, said grooves being shaped and sized to removeably receive said guide member so said guide member extends between said side panels and is substantially perpendicular to said side panels.

* * * * *

UNITED STATES PATENT AND TRADEMARK OFFICE

CERTIFICATE OF CORRECTION

PATENT NO. : 5,362,057

DATED : November 8, 1994

INVENTOR(S) : Juchi Arima

It is certified that error appears in the above-indentified patent and that said Letters Patent is hereby corrected as shown below:

Title page, item [54] and col. 1, line 1, delete "GULF" and substitute therefor--GOLF--.

Column 10, claim 28, line 24, delete "a" and substitute therefor --the--. (second occurrence).

Signed and Sealed this

Twenty-eight Day of March, 1995

Bruce Lehman

*Attest:*

BRUCE LEHMAN

*Attesting Officer*

*Commissioner of Patents and Trademarks*